US010012958B1

(12) United States Patent
Gallimore

(10) Patent No.: US 10,012,958 B1
(45) Date of Patent: Jul. 3, 2018

(54) TIME KEEPING ASSEMBLY WITH PLURALITY OF DISPLAY APPEARANCES AND ASSOCIATED SYSTEMS

(71) Applicant: Paul Antoney Gallimore, Hinton (CA)

(72) Inventor: Paul Antoney Gallimore, Hinton (CA)

( * ) Notice: Subject to any disclaimer, the term of this patent is extended or adjusted under 35 U.S.C. 154(b) by 0 days.

(21) Appl. No.: 15/228,593

(22) Filed: Aug. 4, 2016

Related U.S. Application Data

(60) Provisional application No. 62/203,143, filed on Aug. 10, 2015.

(51) Int. Cl.
*G04G 9/02* (2006.01)
*G04B 19/20* (2006.01)

(52) U.S. Cl.
CPC ..... *G04G 9/02* (2013.01); *G04B 19/202* (2013.01)

(58) Field of Classification Search
CPC ..... G04B 19/00; G04B 19/16; G04B 19/163; G04B 19/20; G04B 19/166
USPC ..... 368/231
See application file for complete search history.

(56) References Cited

U.S. PATENT DOCUMENTS 1,450,996 A * 4/1923 Varaud ..... G04B 19/20 368/231
1,453,086 A * 4/1923 Varaud ..... G04B 19/20 368/231
1,665,073 A * 4/1928 Schwanke ..... G04B 19/166 368/231
5,134,596 A * 7/1992 Harris ..... G04B 19/04 368/228
D359,241 S 6/1995 Ling
D363,229 S 10/1995 Wong
D377,949 S 2/1997 Woldenberg et al.
5,687,140 A * 11/1997 Sekine ..... G04B 19/163 368/231
D387,288 S 12/1997 Wong
5,696,740 A 12/1997 Inabinet
D390,474 S 2/1998 Wong
6,809,992 B1 10/2004 Ermel et al.
6,842,404 B2 * 1/2005 Haselberger ..... G04C 17/005 368/223
7,136,326 B1 11/2006 Smith
2015/0241848 A1 * 8/2015 Willemin ..... G04B 19/32 362/23.16

* cited by examiner

*Primary Examiner* — Sean Kayes
(74) *Attorney, Agent, or Firm* — Malloy & Malloy, PL

(57) ABSTRACT

A time keeping assembly comprises a display configured to present at least a first display appearance and a second display appearance, the first display appearance corresponding to a first time period and, the second display appearance corresponding to a second time period. The first display appearance may also be associated with a color, such as red, while the second display appearance may also be associated with another color, such as blue.

11 Claims, 4 Drawing Sheets

TIME KEEPING ASSEMBLY WITH PLURALITY OF DISPLAY APPEARANCES AND ASSOCIATED SYSTEMS

CLAIM OF PRIORITY

The present application is based on and a claim of priority is made under 35 U.S.C. Section 119(e) to a provisional patent application that is currently in the U.S. Patent and Trademark Office, namely, that having Ser. No. 62/203,143 and a filing date of Aug. 10, 2015, and which is incorporated herein by reference.

BACKGROUND OF THE INVENTION

Field of the Invention

The present invention is directed to systems and apparatus for displaying multiple display appearances of time-keeping devices according to predetermined time periods.

Description of the Related Art

Certain time keeping conventions sometimes call for the use of a twenty-four hour convention, in which the ante meridiem and post meridiem conventions are not utilized due to each hour of the day having a unique numeral identifier, rather than each hour of the day sharing a counterpart which is offset by twelve hours. Accordingly, some time keeping devices attempt to accommodate both conventions on the same face such as where the numerals 1 through 12 are depicted around the face of a time keeping assembly and the numerals 13 through 24 are depicted in a smaller presentation within the face as well. This can lead to confusion regarding the time of day, e.g., whether it is 2:00 AM or PM, or in a twenty-four hour convention, whether it is 0200 hours or 1400 hours, especially in scenarios where it is not easy to discern whether it is day or night. The present invention presents several novel and non-obvious features which address this and other long felt needs in the art.

SUMMARY OF THE INVENTION

In one embodiment the invention comprises a time keeping instrument including a display. The display is configured to selectively present one of a plurality of display appearances that correspond to predetermined time periods. By way of example, the plurality of display appearances may comprise a first display appearance and a second display appearance. The first display appearance may be associated with a first set of numerals, a first display color, and/or a first time period. Likewise, a second display appearance may be associated with a second set of numerals, a second display color, and/or a second time period.

In one embodiment, the invention may comprise a digital display such as a liquid crystal display (LCD), light emitting diode display (LED), "electronic ink" display, and the like which is capable of displaying a digital representation of both the first display appearance and the second display appearance consecutively, along with an hour hand, minute hand, and/or second hand, as well as animations for same which digitally simulate the appearance of one or more time keeping assembly hands sweeping around the display. It will also be appreciated that in such an embodiment, the invention also comprises electronic components, such as display drivers, central processing units (CPU), graphical processing units (GPU), memory (random access memory, read-only memory, and/or flash memory), power supply units (such as AC/DC adaptors for receiving and modulating mains power or a battery compartment for rechargeable or disposable batteries), and the like which are sufficient to accomplish the digital appearance of the first display, second display, and/or animated hour hand, minute hand, or second hand. As such, the electronic components may be preconfigured to display a certain display appearance during a predetermined time period, as well as to display another display appearance during another predetermined time period.

The present invention may also include communications interface such as a network adaptor or other wireless communication facilities so as to receive and/or transmit data pertaining to a time to be displayed on the display of the present invention. Alternatively, or in combination therewith, the present invention may also include a physical interface for establishing and/or modulating a time to be displayed such as physical buttons or touch-sensitive interface.

In yet another embodiment, the present invention may combine such digital displays and display appearances which have been heretofore described, with mechanical time keeping assembly hands that are mounted to the face of such a display.

In yet another embodiment, the invention may include a display assembly comprising a plurality of display plates. Each of the display plates may be made of a translucent or at least partially transparent material such that the plurality of display plates may be disposed in fixed, confronting relation to one another and substantially coaxially aligned, wherein the digital or mechanical hands move relative to the plurality of display plates. Accordingly, due to the translucent or at least partially transparent material, each of said display plates may be selectively illuminated and be visible to a user thereof. In a preferred embodiment, the display plates are comprised of glass or plastic, such as acrylic. Accordingly, in such an embodiment, the numerals may then be etched into the face of the display plate.

In such an embodiment, a first display plate corresponding to a first display appearance may be illuminated during a first display period, while a second display plate corresponding to a second display appearance may be illuminated during a second display period. As such, the second display plate, at least while illuminated, may be visible even though a first display plate may be disposed in front of the second display plate relative to a user of the present invention. In a preferred embodiment, the illumination may be disposed edge-wise along at least a portion of the periphery or circumference of each display plate. Such illumination may comprise a strip of light emitting diodes (LEDs) or any of a variety of suitable illumination which can be disposed about the display plates in an edge-wise manner, whether homogenous in nature, such as fluorescent tubes, or point sources, such as LEDs.

In such an embodiment a standard time keeping assembly movement may be provided to control the time keeping assembly hands. At least one embodiment of the present invention may utilize the time keeping assembly movement to control the selective display or illumination of the plurality of display appearances. By way of example, a switch may be disposed at the twelve o'clock position of the display, in at least partially interfering relation to an hour hand of the present invention. Accordingly, when the hour hand passes the switch, it will trigger same. The switch may be configured to control the display or illumination of the various display appearances and such an embodiment will then be configured to present a different display appearance every twelve hours, such as by alternating between a first display appearance and a second display appearance.

It will be appreciated that in such embodiments, the activating impetus for the switch trigger will always be moving in a clockwise direction. As such, a momentary switch, as opposed to a toggle switch, will be desired as the toggle switch must be toggled back in the opposite direction for continuous activations, while the momentary switch can be configured to activate and deactivate on consecutive throws which are all in the same direction.

By way of example the momentary switch may be a biased switch which is normally-open. Upon a pre-determined hand sweeping past the switch and interfering with same, the switch may then be closed, thereby activating one of the illumination sources while simultaneously deactivating another of the illumination sources.

It may be seen then, that an advantageous arrangement is presented whereby selective display or illumination of one of a plurality of display appearances coinciding with a change between ante meridiem and post meridiem time periods may be utilized in order to efficiently provide such information to a user of the present invention. For example, a display appearance which is associated with the color blue may indicate to a user that the current time period is the ante meridiem time period. By way of further example, a display appearance associated with the color red may indicate to a user that the current time period is the post meridiem time period.

Accordingly, the illumination sources provided may be of such predetermined color associations and disposed in accordance with the corresponding display appearance. For example, in the embodiment described above, an illumination source comprising red LEDs may be provided with the display appearance that includes the post meridiem time period numerals, while an illumination source comprising blue LEDs may be provided with the display appearance that includes the ante meridiem time period numerals. Alternatively, These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
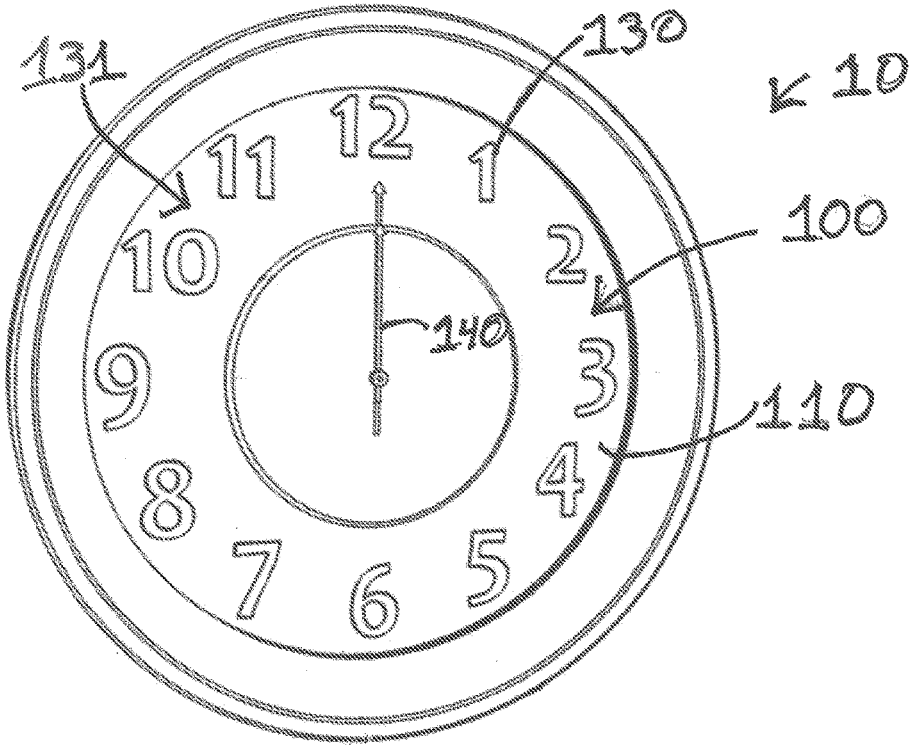
FIG. 1 is a front view of a time-keeping assembly with a first display appearance according to one embodiment of the present invention.
Figure 2:
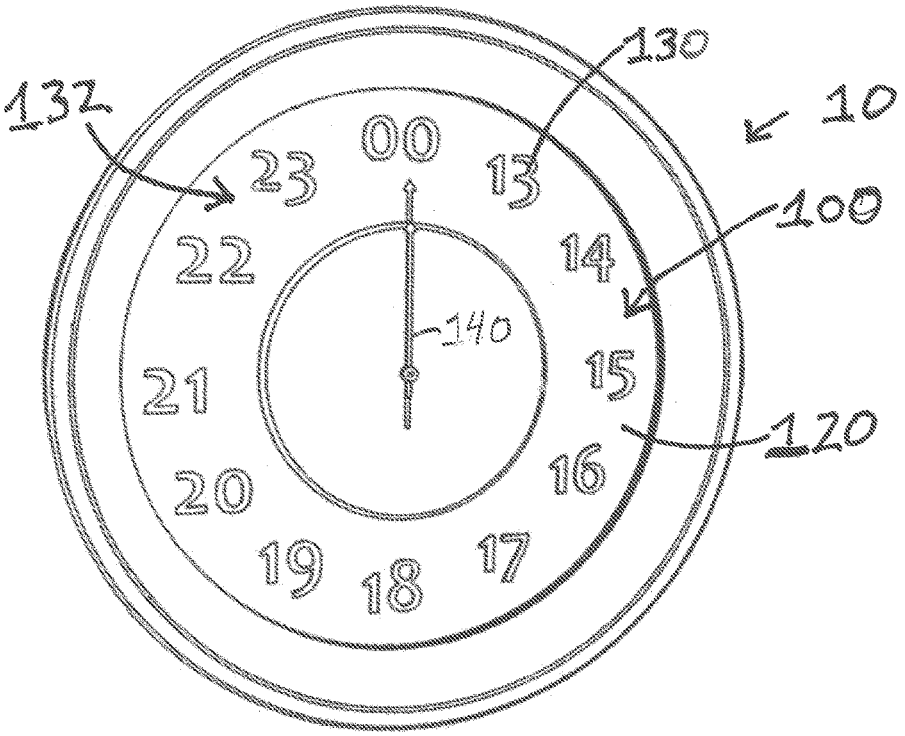
FIG. 2 is a front view of a time-keeping assembly with a second display appearance according to one embodiment of the present invention.

With reference to FIGS. 1 and 2, depicted therein is a time keeping assembly 10 according to one embodiment of the present invention utilizing a digital display 100 to present a plurality of display appearances, including but not limited to, a first display appearance 110 and a second display appearance 120. Each display appearance 110, 120 includes a set of numerals 130, comprising either a first set of numerals 131, or a second set of numerals 132, according to each of a first display appearance 110 or second display appearance 120. As such, the depicted embodiment may be configured to alternately display one of the first display appearance 110 or second display appearance 120 during certain time periods. In one embodiment, the change of display appearance may occur when the hands 140 indicate 1:00 PM or 1300 hours, and a further change of display appearance may occur when the hands 140 indicate 1:00 AM or 0100 hours. In a further embodiment, the first display appearance 110 is displayed during the ante meridiem hours as well as the post meridiem time period through and including 12:59:59 PM, whereupon striking 1:00 PM or 1300 hours, the second display appearance 120 is displayed. The second display appearance 120 may then continue to be displayed throughout the post meridiem hours as well as the ante meridiem time period through and including 12:59:59 AM, whereupon striking 1:00 AM or 0100 hours, the first display appearance 110 is displayed.

In yet another embodiment, the color of the display appearance may change at a different time, and be displayed during a different time period, from the numerals 130 of the display appearance. By way of example, a first display appearance 110 may comprise a first set of numerals 131 (1 through 12) displayed in blue, while a second display appearance 120 may comprise a second set of numerals 132 (13 through 23 and 00, or, 13 through 24) displayed in red. In such an embodiment, the color of the display 100 may be configured to change from blue to red upon striking 12 O'clock noon, but the first set of numerals 131 will be maintained until striking 1 O'clock PM or 1300 Hours, whereupon the second set of numerals 132 are displayed. Additionally, the display is further configured to change from red to blue upon striking 12 O'clock midnight, but the second set of numerals 132 are maintained until striking 1 O'clock AM or 0100 Hours, whereupon the first set of numerals 131 are displayed.

Figure 3:
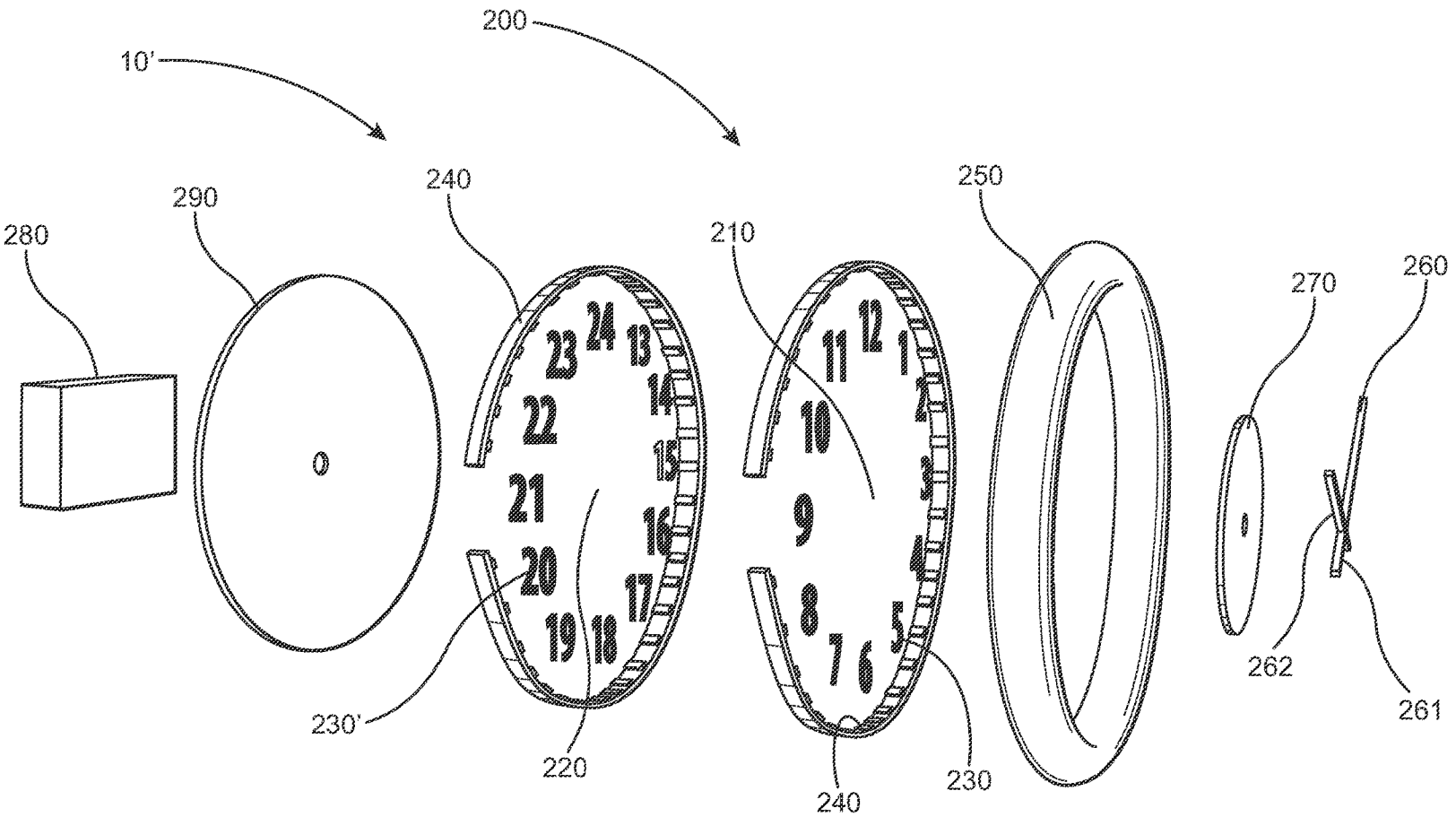
FIG. 3 is an exploded perspective view of a time-keeping assembly according to another embodiment of the present invention.
Figure 4:
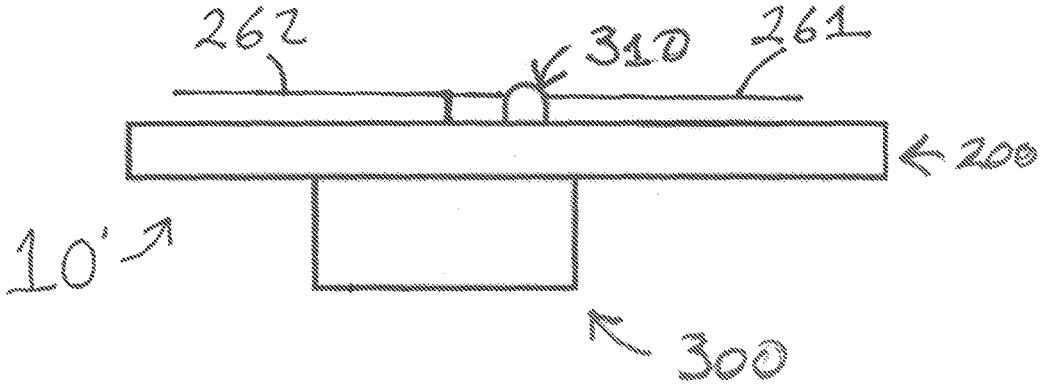
FIG. 4 is a top view of a portion of a time-keeping assembly according to another embodiment of the present invention.

With reference to FIGS. 3 and 4, another embodiment of a time keeping assembly 10' according to the present invention is depicted therein. In such an embodiment, the time keeping assembly 10' may include a display assembly 200, including a plurality of display plates such as a first display plate 210 and second display plate 220, a backing 290, illumination source(s) 240, a frame 250, hands 260, a mounting plate 270, and a time keeping assembly movement 280.

In the depicted embodiment of FIG. 4 each display plate 210, 220 is comprised of a transparent or at least partially translucent material and includes a plurality of numerals 230 and 230' corresponding to each of the display appearances afforded by the first display plate 210 and second display plate 220. In a most preferred embodiment each of the numerals 230, 230' is etched into the surface of the display plates 210, 220. As such, when each illumination source 240 is disposed in an edge-wise relation to, and/or about the periphery of, a corresponding one of the first and second display plates 210, 220, respectively and selectively activated, the corresponding etched numerals 230 and 230' will be illuminated.

The depicted embodiment also includes a set of time keeping assembly hands 260 including at least hour hand 262 and minute hand 261 which are disposed in driven relation to a time keeping assembly movement 280, which can be any of a variety of known movement such as mechanical, electric, and the like. A frame 250 may also be provided in at least partially edge-wise relation to the display plates 210 and 220, in at least partially covering relation to the illumination source(s) 240 extending along at least a portion of the periphery or circumference of each display plates 210 and 220, as represented in FIG. 4. A backing 290 may also be provided. In a preferred embodiment, the backing 290 may be opaque and of a dark color in order to facilitate perception of the illuminated numerals 230 against the backing 290.

With specific reference to FIG. 4, a switch assembly including switch trigger 310 may be provided with the depicted embodiment in order to facilitate selective illumination of the display plates 210 and 220. The switch assembly 300 may be disposed in selective illuminating relation to each of the display plates 210 and 220, thereby controlling which of the display plates 210 and 220 are illuminated during a given time period. A switch trigger 310 may be disposed to be projecting from the display assembly 200 in at last partially interfering relation with at least one of the hands 260, either the hour hand 262 or minute hand 261. Accordingly, when a hand 260 sweeps past the switch trigger 310, the switch assembly 300 is activated, and a predetermined display plate 210 or 220 is selectively illuminated, while the other display plate 210 or 220 is selectively unilluminated.

Accordingly, in embodiments where only one switch trigger 310 is provided, and the switch trigger 310 is further disposed in interfering relation with only the hour hand 262, the switch trigger 310 will only be activated once every twelve hours. In such an embodiment, a particularly useful scheme of alternative display appearances once every twelve hours may be realized, especially where a first display plate 210 comprises the numerals 1 through 12, and a second display plate 220 comprises the numerals 13 through 24.

It will also be appreciated that other arrangements and configurations of switch triggers 310 may be provided. For example, when two switch triggers 310 are disposed 180 degrees apart, both in interfering relation with the hour hand 262, then the switch assembly 300 may be activated once every six hours. Further configurations, including those with switch triggers 310 disposed in interfering relation to the minute hand 261, hour hand 262, or both, may then be realized as well.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A time keeping assembly comprising:

a display assembly comprising at least a first display plate and a second display plate rotationally fixed in coaxial, confronting, relation to one another;

said first display plate configured to present at least a first display appearance and said second display plate configured to present at least a second display appearance;

each of said first and second display plates formed of an at least partially transparent material;

each of said first and second display plates comprising an illumination source extending along at least a portion of a periphery thereof;

said first display appearance corresponding to a first set of numerals and a first color, said first color generated by a correspondingly positioned one of said illumination sources;

said second display appearance corresponding to a second set of numerals and a second color, said second color generated by a correspondingly positioned one of said illumination sources; and said first display plate configured to display at least said first color during a first time period and said second display plate configured to display at least said second color during a second time period.

2. The time keeping assembly as recited in claim 1 wherein said display is configured to automatically display either said first display appearance or said second display appearance in accordance with either said first time period or said second time period.

3. The time keeping assembly as recited in claim 2 wherein said first time period corresponds with the ante meridiem time period.

4. The time keeping assembly as recited in claim 3 wherein said second time period corresponds with the post meridiem time period.

5. The time keeping assembly as recited in claim 1 wherein said first color of said first display appearance is displayed concurrently with said second set of numerals for at least a portion of said first time period.

6. The time keeping assembly as recited in claim 1 wherein said second color of said second display appearance is displayed concurrently with said first set of numerals for at least a portion of said second time period.

7. The time keeping assembly as recited in claim 1 wherein said first display appearance partially comprises the numerals 1 through 12, consecutively.

8. The time keeping assembly as recited in claim 7 wherein said second display appearance partially comprises the numerals 13 through 24, consecutively.

9. The time keeping assembly as recited in claim 7 wherein said second display appearance partially comprises the numerals 13 through 23, consecutively, and the numeral 00.

10. The time keeping assembly as recited in claim 1 wherein said first and second display plates respectively comprise said first set of numerals and said second set of numerals etched on to a face thereof.

11. The time keeping assembly as recited in claim 1 wherein a change in display of said first set of numerals to said second set of numerals occurs at a different time than a change in display of said first color to said second color; a change in display of said second set of numerals to said first set of numerals occurs at a different time than a change in display of said second color to said first color.

* * * * *